US007233324B2

(12) United States Patent
Sugiyama et al.

(10) Patent No.: US 7,233,324 B2
(45) Date of Patent: Jun. 19, 2007

(54) DISPLAY DEVICE, DRIVE CIRCUIT, TESTING DEVICE, AND RECORDING MEDIUM

(75) Inventors: Hiroaki Sugiyama, Yokohama (JP); Taketoshi Nakano, Kawasaki (JP); Toshihiro Yanagi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 551 days.

(21) Appl. No.: 10/694,828

(22) Filed: Oct. 29, 2003

(65) Prior Publication Data

US 2004/0085275 A1 May 6, 2004

(30) Foreign Application Priority Data

Jan. 10, 2003 (JP) ..... 2003-005042

(51) Int. Cl.
*G09G 5/00* (2006.01)
*G09G 3/36* (2006.01)

(52) U.S. Cl. ..... 345/204; 345/104; 348/180; 324/770

(58) Field of Classification Search ..... 345/87, 345/107, 204, 104; 324/770; 348/180, 189
See application file for complete search history.

(56) References Cited

U.S. PATENT DOCUMENTS 5,671,011 A * 9/1997 Kim ..... 348/189
5,963,249 A * 10/1999 Kim ..... 348/178
7,023,470 B2 * 4/2006 Braun ..... 348/180

FOREIGN PATENT DOCUMENTS

| | | |
|---|---|---|
| JP | 05-341748 | 12/1993 |
| JP | 09-230313 | 9/1997 |
| JP | 11-272222 A | 10/1999 |

* cited by examiner

*Primary Examiner*—Jimmy H. Nguyen
(74) *Attorney, Agent, or Firm*—Harness, Dickey & Pierce

(57) ABSTRACT

A display device is provided with a display panel, and a source driver and a gate driver both for driving the display panel and includes a nonvolatile memory for storing a test sequence representing the procedures for a display test and testing patterns to be displayed in the display test and a control section for, in accordance with a test control signal supplied externally, controlling the source driver and the gate driver so as to display the testing patterns on the display panel in accordance with the test sequence. Since the test sequence and the testing patterns are stored in the nonvolatile memory of the display device, this eliminates the need for cumbersome and extensive tasks of preparing testing devices respectively corresponding to the models of the display device and a great number of complex data of the test sequence and the testing pattern which are respectively suitable for the models of the display device and storing them in the testing devices, respectively. That is, it is possible to drastically reduce preparations for a display test.

15 Claims, 10 Drawing Sheets

FIG. 2

| ADDRESS | FLAG | DATA |
|---|---|---|
| 1 | 00 | MODULE INITIALIZATION |
| 2 | 00 | FULL DISPLAY MODE |
| 3 | 10 | THE NUMBER OF TIMES FOR REPEATING A PATTERN (176×220) |
| 4 | 01 | TESTING PATTERN RED |
| 5 | 01 | TESTING PATTERN CHECKER |
| 6 | 00 | PARTIAL DISPLAY MODE |
| 7 | 10 | THE NUMBER OF TIMES FOR REPEATING A PATTERN (176×40) |
| 8 | 01 | TESTING PATTERN RED |

| ADDRESS | FLAG | DATA |
|---|---|---|
| 000 | 01 | 4 PIXELS ALL BLACK |
| 001 | 01 | 4 PIXELS ALL WHITE |
| 010 | 01 | 4 PIXELS ALL RED |
| 011 | 01 | 4 PIXELS ALL GREEN |
| 100 | 01 | 4 PIXELS ALL BLUE |
| 101 | 01 | 4 PIXELS A: WHITE B: BLACK C: BLACK D: WHITE |
| 110 | 01 | 4 PIXELS A: WHITE B: WHITE C: BLACK D: BLACK |
| ⋮ | ⋮ | ⋮ |

FIG. 8

| | COMMAND NAME | COMMAND DESCRIPTION | COMMAND (HEXADECIMAL NOTATION) |
|---|---|---|---|
| | RAM ADDRESS | DESIGNATION OF THE LOCATION WHERE DATA ARE WRITTEN | 01 |
| | INVERSION ON | INVERSION ON | 05 |
| | INVERSION OFF | INVERSION OFF | 06 |
| | ⋮ | (OTHER USER COMMANDS) | |
| | PARTIAL ON | PARTIAL DISPLAY MODE | C0 |
| | PARTIAL OFF | FULL DISPLAY MODE | C1 |
| TEST COMMAND | TEST IN | TEST MODE ON | F0 |
| TEST COMMAND | TEST OUT | TEST MODE OFF | F1 |
| TEST COMMAND | TEST INC | TEST SEQUENCE GO FORWARD | F2 |
| TEST COMMAND | TEST DEC | TEST SEQUENCE GO BACK | F3 |

Convential Art

DISPLAY DEVICE, DRIVE CIRCUIT, TESTING DEVICE, AND RECORDING MEDIUM

FIELD OF THE INVENTION

The present invention relates to a display device such as liquid crystal display device, more specifically, relates to a display device with the content of a display test varied depending on the model of the display device and a testing device for the display device.

BACKGROUND OF THE INVENTION

In a display test for the display devices including command interface, such as liquid crystal display device for mobile phone, a plurality of signal source devices for use in testing are needed for the reason of different command systems depending on users or for other reasons. In addition, a plurality of control programs for testing device must be prepared for the reason of different testing patterns to be displayed depending on users or for other reasons.

As shown in FIG. 10, a conventional liquid crystal display device 70 has a display panel 71 and includes a source driver 72 and a gate driver 73 both for driving the display panel 71. Further, the source driver 72 is integrally provided with a data control section 77 and a RAM 74, which constitutes a driver output section. Note that, the data control section 77 may be separated from the source driver 72.

Further, in the liquid crystal display device 70, a nonvolatile memory 75 such as EEPROM stores a setting value for driving the display panel 71 and others. The data control section 77 reads data in the nonvolatile memory 75 into the RAM 74 to use them.

In the liquid crystal display device 70, during a display test, the data control section 77 is connected to a signal source device 80 via an input signal terminal 76. Meanwhile, in the signal source device 80, a test sequence and testing patterns which are suitable for the liquid crystal display device 70, which is a testing target, are stored beforehand in a storage device 82. In the display test, a control microcomputer 81 reads out the test sequence and the testing patterns from the storage device 82 to generate a display signal and supplies the display signal to the data control section 77 in the liquid crystal display device 70 via the input signal terminal 76. With this arrangement, the source driver 72 and the gate driver 73 are driven in accordance with the test sequence under instructions from the signal source device 80, and the testing pattern is displayed on the display panel 71. Note that, in the display test, the liquid crystal display device 70 is supplied a drive-use electric power from a power source 83 of the signal source device 80.

Note that, as prior art documents related to the present invention, there are the following patent documents 1 and 2.

[Patent Document 1]

Japanese Laid-Open Patent Application No. 230313/1997 (Tokukaihei 9-230313; published on Sep. 5, 1997)

[Patent Document 2]

Japanese Laid-Open Patent Application No. 341748/1993 (Tokukaihei 5-341748; published on Dec. 24, 1993)

However, in the conventional structure, since the test sequence and the testing patterns were stored in the storage device 82 of the signal source device 80, the tasks of preparing the test sequence and the testing patterns both of which are suitable for each model of the liquid crystal display device 70 and storing them in the storage device 82 was required for each model of the liquid crystal display device 70. Moreover, the signal source device 80 had an intricate circuitry.

Therefore, a display test for a liquid crystal display device with a large number of models, such as mobile phone, required cumbersome and extensive works of preparing a great number of complex data of the test sequence and the testing pattern and storing them in a great number of signal source devices.

SUMMARY OF THE INVENTION

An object of the preset invention is to provide a display device which can drastically reduce preparations for display test and a test device for the display device.

In order to achieve the above object, a display device of the present invention is provided with a display panel, and a source driver and a gate driver both for driving the display panel and includes a nonvolatile memory for storing a test program including a test sequence representing the procedures for a display test and testing patterns to be displayed in a display test, and a control section for, in accordance with a test control signal supplied externally, controlling the source driver and the gate driver so as to display the testing patterns on the display panel in accordance with the test sequence.

According to the above arrangement, on the display device, which is a testing target, mounted is a nonvolatile memory (for example, EEPROM) which stores a test sequence representing the procedures for a display test such as change of a display mode and testing display patterns. Then, the control section reads out the test sequence and the testing patterns from the nonvolatile memory in accordance with a test control signal supplied from an external testing device and controls the source driver and the gate driver so as to display the testing patterns on the display panel in accordance with the test sequence.

This makes it possible to carry out a display test using the test sequence and the testing patterns incorporated in the display device. Therefore, unlike the conventional testing device, there is no need to incorporate the test sequence and the testing patterns in the testing device.

Consequently, the display test for a display device with a large number of models requires no cumbersome and extensive tasks of preparing testing devices respectively corresponding to the models of the display device and a great number of complex data of the test sequence and the testing pattern which are respectively suitable for the models of the display device and storing them in the testing devices, respectively. That is, it is possible to drastically reduce preparations for a display test.

Note that, the test sequence and the testing patterns, grouped together in one testing program, can be stored in the nonvolatile memory. As to the testing pattern, image information with minimum unit (for example, 2×2 pixels) that has been stored in the nonvolatile memory is displayed on the display panel longitudinally and laterally in repeating fashion, thus realizing a small capacity of the nonvolatile memory.

For a fuller understanding of the nature and advantages of the invention, reference should be made to the ensuing detailed description taken in conjunction with the accompanying drawings.

BRIEF DESCRIPTION OF THE DRAWINGS

FIG. 2 is an explanatory view showing an example of a testing program for the display device shown in FIGS. 1 and 7.

FIG. 8 is an explanatory view showing an example of a test command list of the display device shown in FIG. 7.

DESCRIPTION OF THE EMBODIMENTS

First Embodiment

Referring to FIGS. 1 through 6, the following will describe one embodiment of the present invention.

Figure 1:
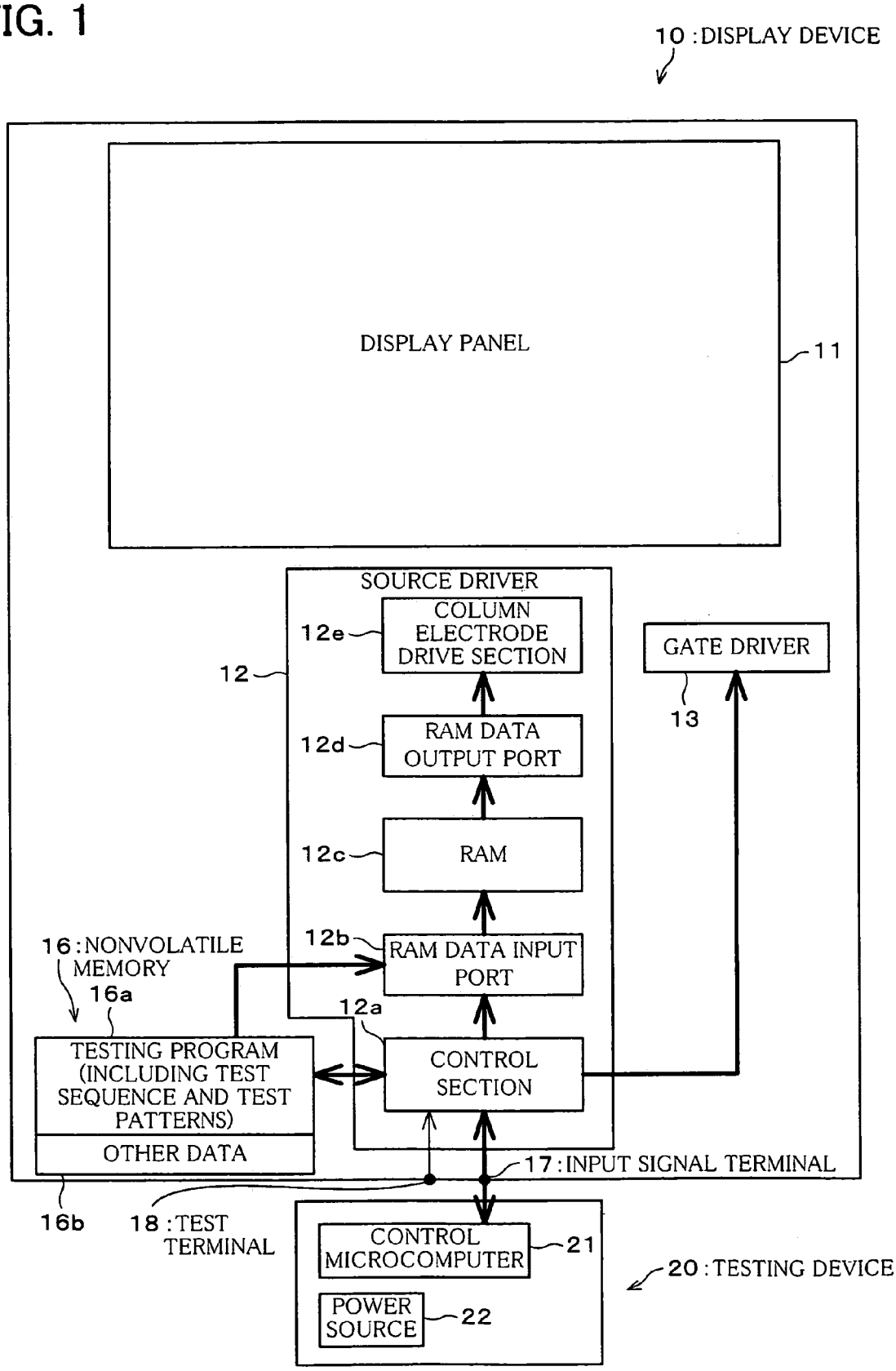
FIG. 1 is a block diagram schematically showing a structure of a display device according to one embodiment of the present invention.

As shown in FIG. 1, a display device 10 according to the present embodiment has a display panel (display means) 11 such as liquid crystal and includes a source driver (column electrode drive circuit) 12 and a gate driver (row electrode drive circuit, drive means) 13 both for driving the display panel 11. In addition, the display device 10 includes a nonvolatile memory (nonvolatile storage means) 16.

Further, in the display device 10, the source driver 12 includes a control section 12*a*, a RAM data input port (image data writing means) 12*b*, a RAM (random-access memory) 12*c*, a RAM data output port (image data reading means) 12*d*, and a column electrode drive section (drive means) 12*e*. Note that, the control section 12*a*, the RAM data input port 12*b*, the RAM 12*c*, and the RAM data output port 12*d* are equivalent to interface means.

The control section 12*a* is connected to the column electrode drive section 12*e* for driving column electrodes (not shown) of the display panel 11, via the RAM data input port 12*b*, the RAM 12*c*, and the RAM data output port 12*d*. The RAM 12*c* is connected to the RAM data input port 12*b* and the RAM data output port 12*d*. With this arrangement, data writing and reading are carried out. Further, the control section 12*a* is connected to the gate driver 13 for driving row electrodes (not shown) of the display panel 11. The control section 12*a* and the RAM data input port 12*b* are connected to the nonvolatile memory 16. Note that, the control section 12*a* and the RAM 12*c*, which are provided internally in the source driver 12 in FIG. 1, may be provided externally.

The nonvolatile memory 16 stores a testing program 16*a* for a display test. In the display device 10, the testing program 16*a* includes a test sequence representing the procedures for a display test and testing patterns each representing image information to be displayed for the display test, which are stored integrally in one memory area. However, the test sequence and the testing patterns may be stored independently in separate memory areas.

Although not shown in FIG. 1, the source driver 12 and the gate driver 13 are provided on the periphery of the display panel 11. Further, the nonvolatile memory 16, which is installed on other substrate, is connected to the control section 12*a* and the RAM data input port 12*b*. Note that, on the substrate on which the nonvolatile memory 16 is installed, a power source IC and various passive components other than the nonvolatile memory 16 may be mounted.

The testing device 20 includes a control microcomputer 21 and transmits a test control signal for display test from the control microcomputer 21 to the display device 10. The testing device 20 supplies a pulse signal for executing the testing program 16*a* via a test terminal 18, if the test terminal 18 is provided separately. Although not shown in FIG. 1, in the display test, electricity for driving the display device 10 can be supplied from a power source 22 of the testing device 20. Note that, in normal displays, display data are inputted to an input signal terminal 17.

Figure 10:
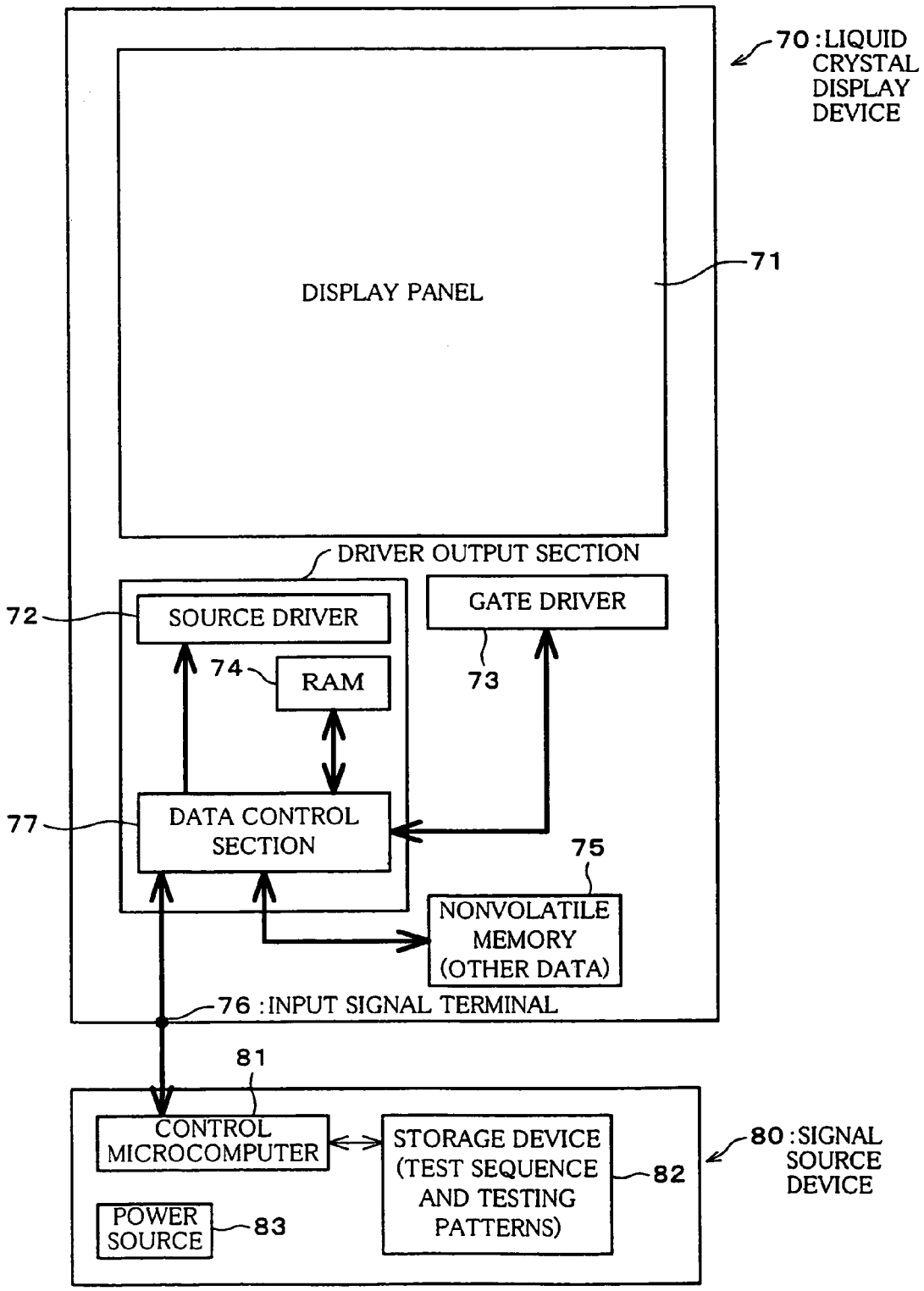
FIG. 10 is a block diagram schematically showing a structure of a liquid crystal display device according to a conventional art.

Note that, since the testing program 16*a* including the test sequence and testing patterns is stored in the nonvolatile memory 16 of the display device 10, the testing device 20 does not need such an intricate circuitry as the signal source device 80 (FIG. 10) including a conventional MPU (microprocessor unit).

Here, in the RAM 12*c*, data are stored via the RAM data input port 12*b*. The RAM data input port 12*b* usually consists of n-bit (e.g. 8 bits, 9 bits, or 16 bits) per unit×m-ports, at the time that predetermined data are all written into the RAM data input port 12*b*, the data are written all together into the RAM 12*c* at once. Usually, the number of RAM input ports changes in accordance with various design constraints of IC. For easy understanding of the operations, the following description assumes that the RAM 12*c* has one line (row) of ports.

Thus, normal pictorial image data are transmitted from the nonvolatile memory 16 to the RAM data input port 12*b* under the control of a test-use display pattern by the control section 12*a*.

When the control section 12*a* detects the test control signal supplied from the test terminal 18, it changes a display mode from normal mode to test mode. This allows the display device 10 to change the display mode between the normal mode for normal displays and the test mode for testing pattern displays.

In the display test, the control section 12*a* reads the testing program 16*a* from the nonvolatile memory 16 in accordance with the test control signal supplied via the test terminal 18 from the testing device 20, generates image data specified by the testing program 16*a*, and writes the generated image data into the RAM 12*c* via the RAM data input port 12*b*.

Then, the RAM data output port 12*d*, which is connected to the column electrode drive section 12*e*, reads out the image data that has been written into the RAM 12*c* and supplies them to the column electrode drive section 12*e* and the gate driver 13 in accordance with timings of the column electrode drive section 12*e* and the gate driver 13. This allows the display device 10 to show normal displays in the normal mode and the testing pattern displays in the test mode on the display panel 11.

Note that, the display device 10 may additionally include other display modes, e.g. a display mode in which the number of colors is reduced to lower power consumption, as well as the normal mode corresponding to a model specification.

The nonvolatile memory 16 can be realized by EEPROM (electrically erasable and programmable ROM). The nonvolatile memory 16 stores, as the testing program 16*a*, the test sequence representing the procedures for a display test and the testing patterns each representing image information to be displayed for the display test. Note that, in addition to the testing program 16*a*, the nonvolatile memory 16 can store, as other data 16*b*, data for driving the display panel 11, e.g. a setting value in the normal mode. Note that, the content and amount of other data 16*b* vary depending on the model of the display device 10.

The testing program 16*a* is transferred from the nonvolatile memory 16 to the control section 12*a* and then written into the RAM data input port 12*b*. In the testing program 16*a*, the testing pattern is incorporated as a command. The testing pattern, which is image information with minimum unit, is repeatedly written into the RAM data input port 12*b* to generate repeated patterns in the lateral direction in the display test. Repeatedly written those data also generate repeated patterns in the longitudinal direction in the RAM 12*c*.

As described above, in the display device 10, the control section 12*a* writes image data into the RAM 12*c* via the RAM data input port 12*b* in accordance with the testing program 16*a* under instructions from the testing device 20, and the RAM data output port 12*d* reads out the written image data and supplies them to the column electrode drive section 12*e*. Further, the gate driver 13 directly receives a control signal from the control section 12*a*. This allows the display device 10 to drive row electrodes and column electrodes of the display panel 11 so as to display a testing pattern, thus making it possible to carry out a display test.

Especially, the source driver 12 includes the RAM data input port 12*b* and the control section 12*a* controlling the RAM data input port 12*b* and all other members (the RAM 12*c*, the nonvolatile memory 16, gate driver 13, etc.). The RAM data input port 12*b* is one line of line memory. In the normal displays on the screen, data from an input bus (the input signal terminal 17) are latched as needed, and when the data are all lined up in the RAM data input port 12*b*, the data are transferred and written all together at once into the RAM 12*c*. On the other hand, in the testing pattern displays, the control section 12*a* repeatedly reads image data with minimum unit from the nonvolatile memory 16, instead of data from the input bus, and writes the image data into the RAM data input port 12*b* to copy the patterns in the lateral direction. Further, without any change of data in the RAM data input port 12*b*, addresses written into the RAM 12*c* are incremented to copy the patterns in the longitudinal direction. Note that, the control section 12*a* consists of the number of bits inputted by n (n is a given number), and actual operations of the control section 12*a* are little more complicated.

FIG. 2 shows an example of the testing program 16*a*. As shown in FIG. 2, the testing program 16*a* consists of eight steps. The testing program 16*a* is executed by incrementing addresses 1 through 8 in accordance with a pulse signal supplied through the test terminal 18.

One step is made up of one command, and an address is allocated to each step in the order in which the steps are executed. In one command, flag and data are described. The flag indicates a class of command contents described in data. For example, contents such as "change of display mode" for the flag "00", "designation of the number of times for repeating a pattern" for the flag "10", and "designation of testing pattern" for the flag "01" are stored in the data area. Note that, the entity of a program code is stored in the data area.

For example, in the command "module initialization" of address 1, the processes of power-on, start of digital circuit's operation, and start of internal analog circuit's operation are carried out sequentially. In the command "change of display mode" of addresses 2 and 6, a change between "full display mode" and "partial display mode" is carried out. Note that, "full display mode" and "partial display mode" will be described later.

Next, operations in the display test will be described. Note that, the following description assumes that the test terminal 18 includes terminals, Test 1 and Test 2.

The display test for the display device 10 starts when the control section 12*a* detects the test control signal (pulse signal) supplied via the test terminal 18 from the testing device 20. Then, the testing program 16*a* are read one by one in steps from the nonvolatile memory 16 into the control section 12*a*. On the other hand, display data for a test are supplied to the RAM data input port 12*b*. The code of the testing program 16*a* is executed serially in accordance with the pulse signal supplied from the test terminal 18.

Specifically, when "H" of a pulse signal is inputted to the terminal Test 1, the control section 12*a* goes into display test mode. Thereafter, every time "H" of a pulse signal is inputted to the terminal Test 2, the address of the testing program 16*a* is incremented, and a signal is supplied to the source driver 12. That is, in accordance with the input of a pulse signal to the terminal Test 2, an address for reading the testing program 16*a* stored in the nonvolatile memory 16 is incremented to proceed with the test sequence.

Figure 3:
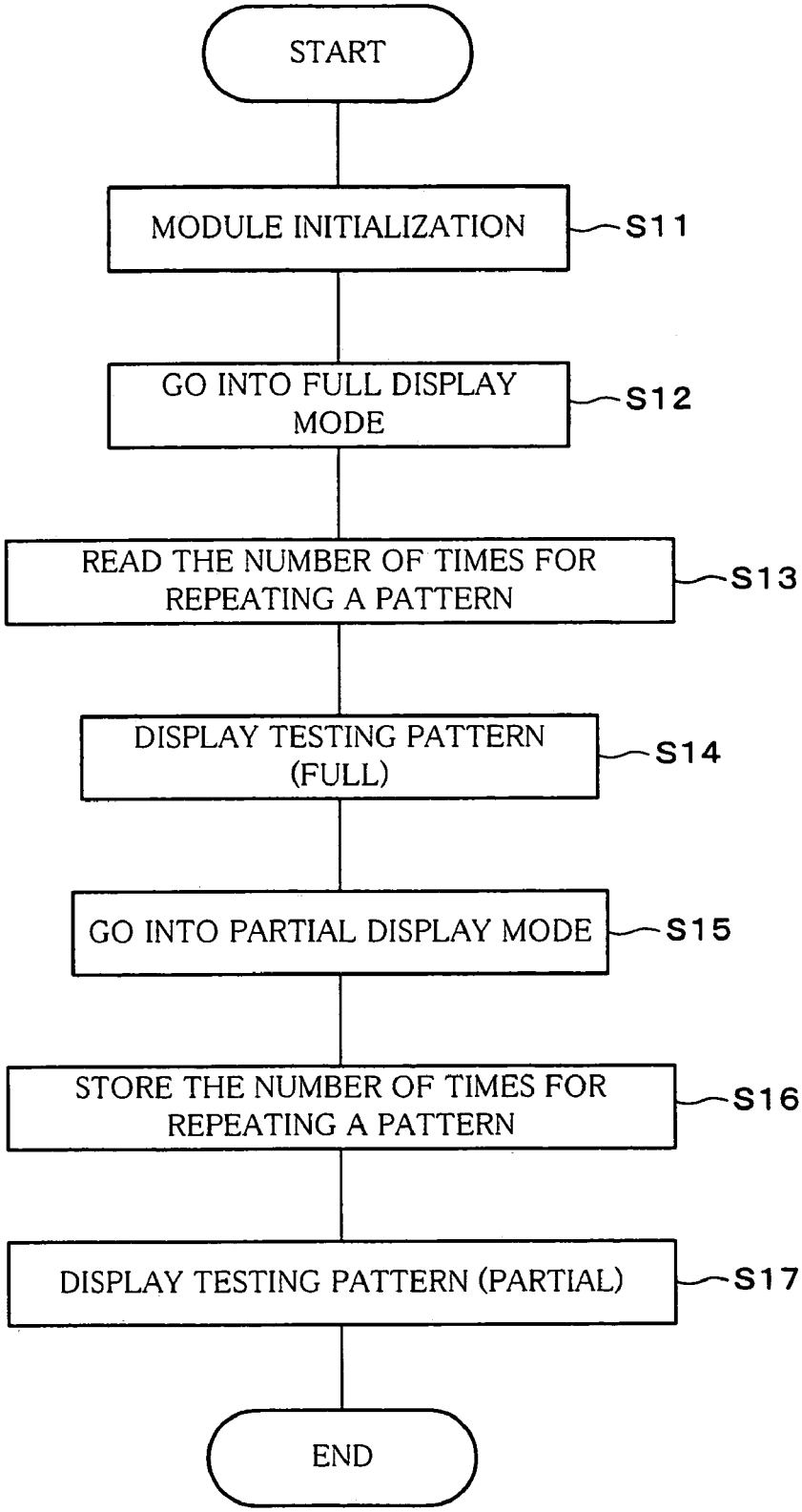
FIG. 3 is a flowchart showing operations of the display device by the testing program shown in FIG. 2.

FIG. 3 is a flowchart showing the operations by the testing program 16*a* shown in FIG. 2. The control section 12*a* performs the following processing by reading and processing a command for each step to control the source driver 12 and the gate driver 13.

A module is initialized (S11). Then, the display mode goes into the full display mode (S12). In the full display mode, the number of times for repeating the testing pattern is read (S13), and the testing pattern is displayed on the entire display panel 11 (S14). At this moment, after "red" (FIG. 4(*a*)) is displayed on the entire screen, "checker" (FIG. 4(*b*)) is displayed on the entire screen.

Next, the display mode goes into the partial display mode (S15). In the partial display mode, the number of times for repeating the testing pattern is read (S16), and the testing pattern is displayed partially on the display panel 11 (S17). At this time, "red" (FIG. 4(*c*)) is displayed partially on the screen.

Figure 4:
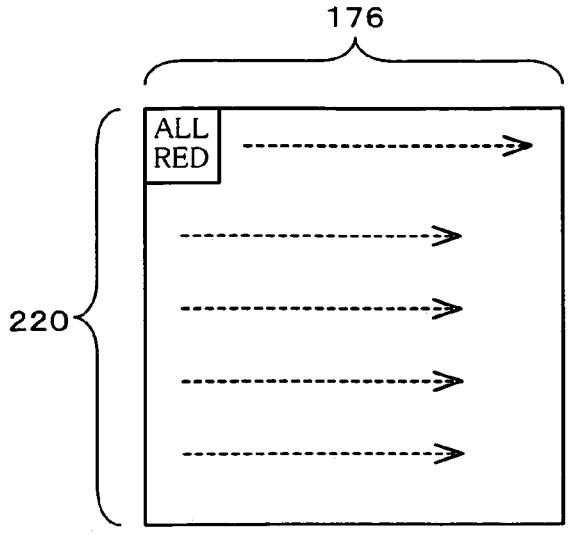
FIG. 4(*a*) through FIG. 4(*c*) are explanatory views of display patterns to be displayed in a display test for the display device shown in FIGS. 1 and 7, FIG. 4(*a*) and FIG. 4(*b*) show an example of full display mode, and FIG. 4(*c*) shows an example of partial display mode.
Figure 4:
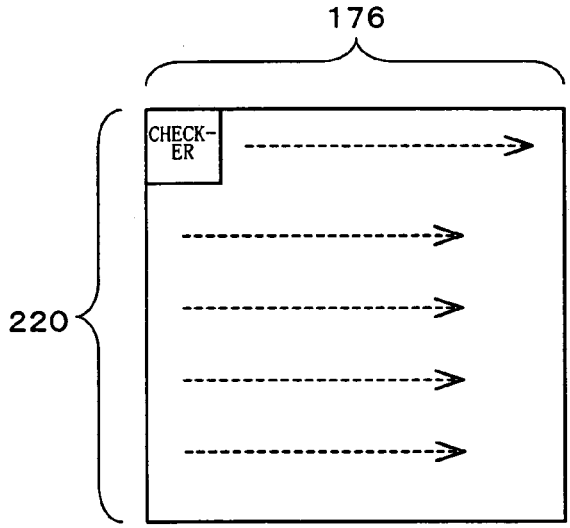
Figure 4:
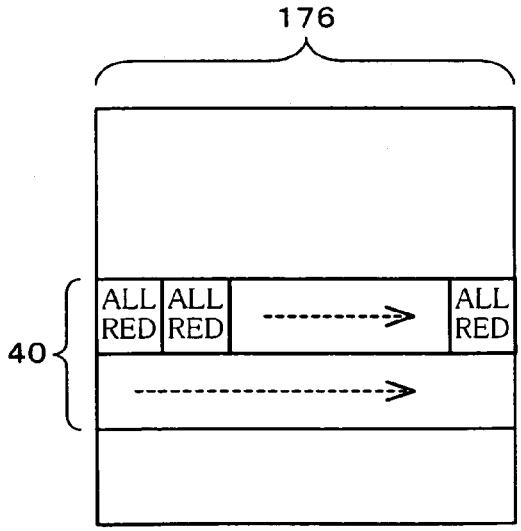

Here, the type of the test mode for the display device 10 includes the "full display mode" and the "partial display mode". The "full display mode" is a mode for displays of the testing pattern on the entire display panel 11. The "partial display mode" is a mode for displays with reduced power consumption. For example, in the partial display mode, a minimum indication such as icons including an antenna and a clock is shown on the display panel 11 for mobile phone. Note that, in the display device 10, the control section 12*a* writes a screenful of image data into the RAM 12*c* with one pulse input. Note that, the size of the display panel 11 shown in FIG. 4 is an example size for a general mobile phone.

Figure 5:
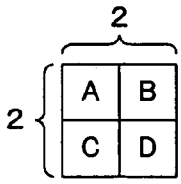
FIG. 5 is an explanatory view showing a descriptive example of commands for testing patterns in the testing program shown in FIG. 2.

Further, FIG. 5 shows a descriptive example of the command for the testing pattern in the testing program 16*a*. Address 010 in FIG. 5 corresponds to addresses 3 and 8 in FIG. 2, and address 101 in FIG. 5 corresponds to address 5 in FIG. 2. In this example, in the data area for the command, a drawing region of the testing pattern and color information for each pixel in the drawing region are described.

Figure 6:
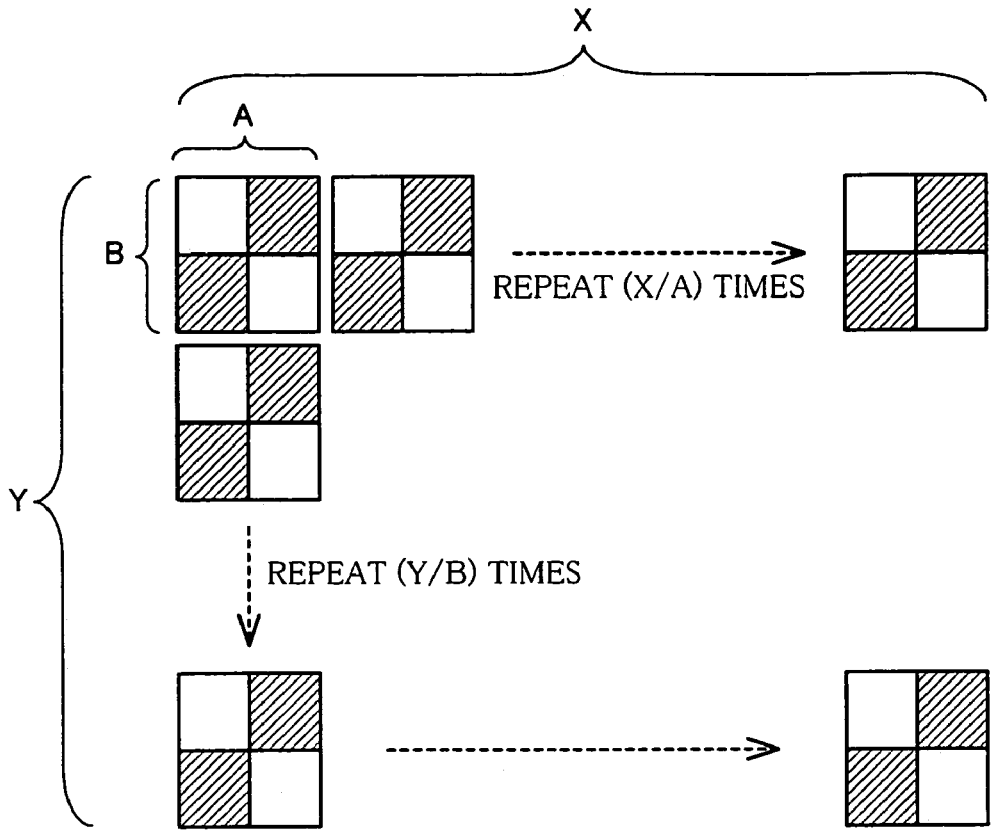
FIG. 6 is an explanatory view showing how to display a display pattern in a display test for the display device shown in FIGS. 1 and 7.

That is, as shown in FIG. 6, in the case where resolution of the display panel 11 is X×Y, minimum image information (for example, 2×2) as a unit is laterally displayed (X/A) times in repeating fashion and. longitudinally displayed (Y/B) times in repeating fashion, thus realizing a full-screen display. In the case where the minimum image information is 2×2, display pattern with one color in four pixels (red, green, blue, white, or black), checkered display pattern, and display pattern with lateral/longitudinal stripes every one line are possible.

Thus, the display device 10 incorporates the testing program 16*a* including the test sequence and the image information for the testing patterns in the nonvolatile memory 16. This eliminates the need for the preparation of a large number of testing devices 20 and many intricate testing programs, which were required for a module with a large number of models.

Further, in the display device 10, image information with minimum unit (1×1 pixel, 2×2 pixels, or other unit) that has been stored as image information for the testing pattern is displayed longitudinally and laterally in repeating fashion, thus realizing a small capacity of the nonvolatile memory 16.

Note that, although the above description was based on the case of storing one testing program 16*a* in the nonvolatile memory 16, it is also possible to store a plurality of testing programs and to externally designate a testing program to be executed out of the testing programs. Specifically, additional terminals may be provided for selection of the testing programs, or without increasing the number of signal lines, testing programs may be transferred with serial communications using the test terminal 18. Even in the manufacturing process that requires various display tests, this makes it possible to change a plurality of testing programs to distinguish among the uses of multiple test sequences.

Second Embodiment

The following will describe another embodiment of the present invention with reference to FIGS. 7 through 9 and FIGS. 2 through 6. Note that, for the purpose of explanation, members having the same functions as those described in the First Embodiment are given the same reference numerals and explanations thereof may be omitted here. The terms defined in the First Embodiment are also used as they are in the present embodiment unless otherwise specified.

In a display device 30 according to the present embodiment, instead of the control section 12*a* and the nonvolatile memory 16 provided in the display device 10 of the First Embodiment (FIG. 1), an interface section (interface means) 34 and a nonvolatile memory 36 are provided. Therefore, the following will focus on the differences from the First Embodiment including the interface section 34 and the nonvolatile memory 36.

Figure 7:
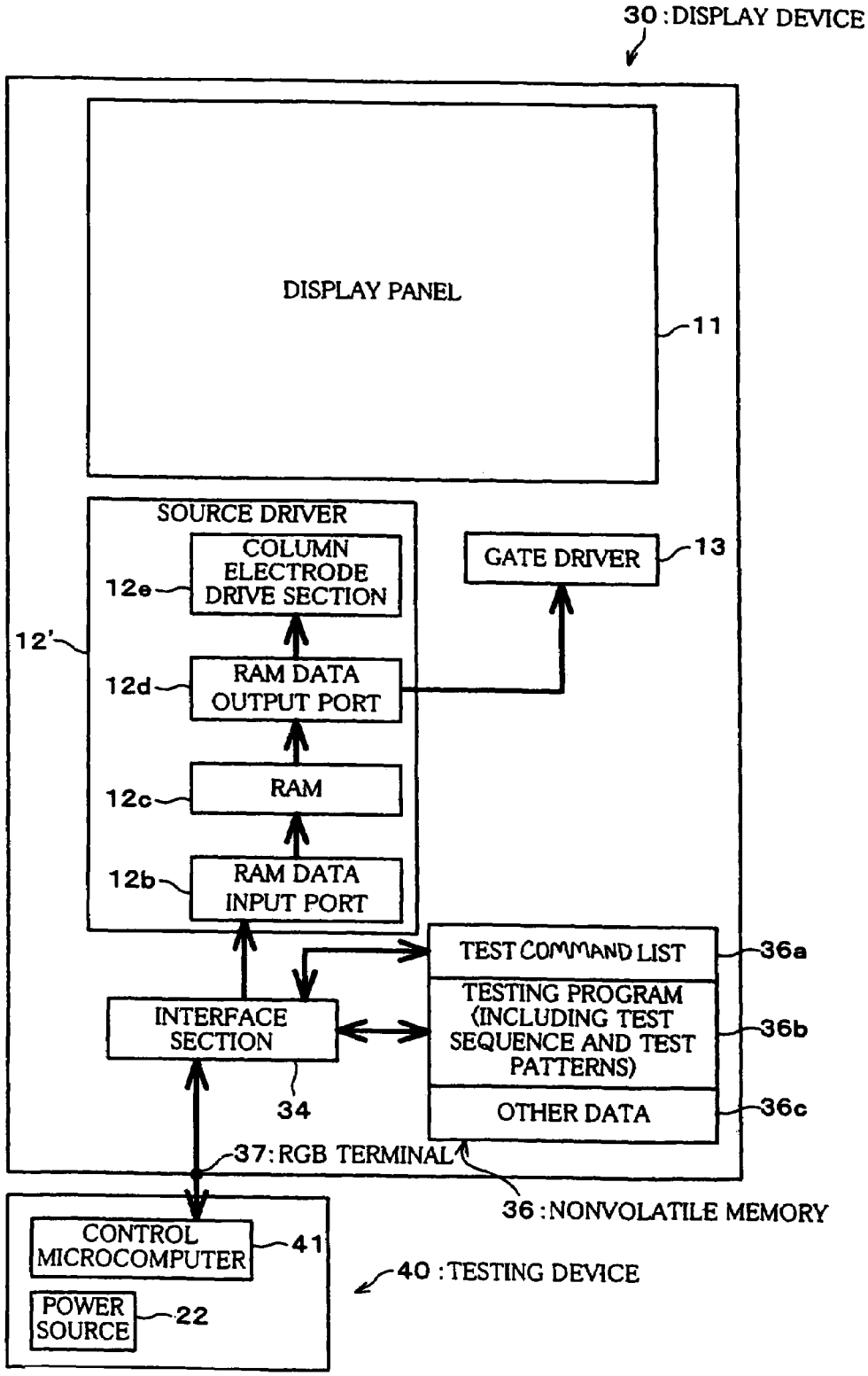
FIG. 7 is a block diagram schematically showing a structure of a display device according to another embodiment of the present invention.
Figure 9:
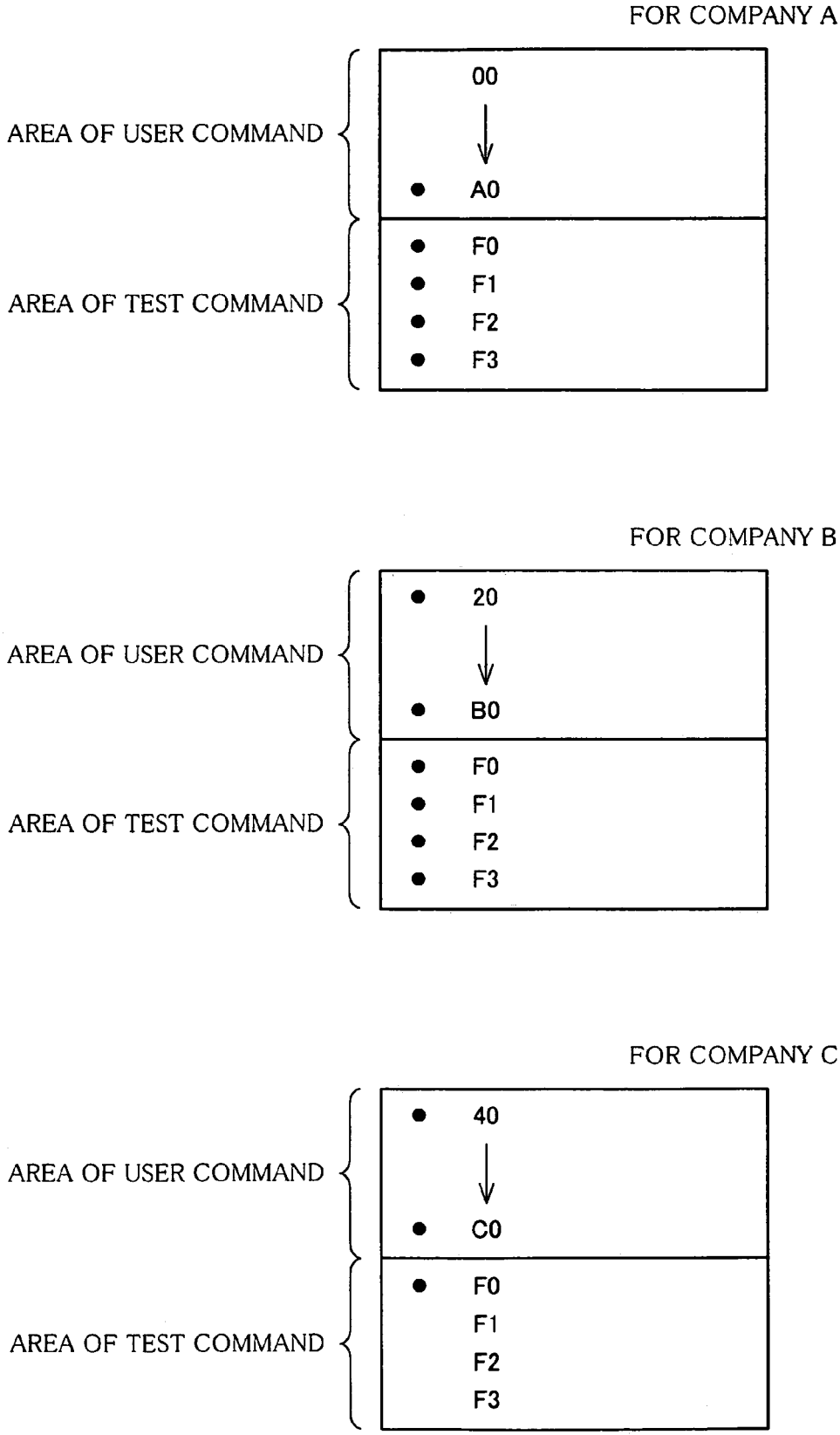
FIG. 9 is an explanatory view showing the locations where user commands and test commands are stored in a nonvolatile memory provided in the display device shown in FIGS. 1 and 7.

As shown in FIG. 7, the display device 30 has a display panel 11 such as liquid crystal and includes a source driver (column electrode drive circuit) 12' and a gate driver (row electrode drive circuit) 13 both for driving the display panel 11.

The source driver 12' is connected via the interface section 34 to the nonvolatile memory 36 and an external testing device 40. In the nonvolatile memory 36, a test command list 36*a* and a testing program 36*b* are stored for a display test. This allows the display device 30 to carry out a display test by driving electrodes of the display panel 11 so as to display a testing pattern under instructions from the testing device 40 in accordance with the test command list 36*a* and the testing program 36*b*.

Note that, in the display device 30, a reference table for identifying commands supplied from the testing device 40 is stored in the test command list 36*a*. The testing program 36*b*, as with the testing program 16*a* (FIG. 1), includes a testing sequence representing the procedures for a display test and testing patterns each representing image information to be displayed for the display test, which are stored integrally in one memory area. The test command list 36*a* and the testing program 36*b* may be stored independently in separate memory areas.

Although not shown in FIG. 7, the source driver 12' and the gate driver 13 are provided on the periphery of the display panel 11. Further, the interface section 34 and the nonvolatile memory 36, which are installed on respectively different substrates, are connected to the control section 12'. Note that, on the substrate on which the nonvolatile memory 36 is installed, a power source IC and various passive components other than the nonvolatile memory 36 may be mounted.

The testing device 40 includes a control microcomputer 41 and transmits a test control signal for display test from the control microcomputer 41 to the display device 30. Especially, the testing device 40 supplies a test command for executing the testing program 36*b* via a RGB terminal 37. Although not shown in FIG. 7, in the display test, electricity for driving the display device 30 can be supplied from a power source 22 of the testing device 40.

Note that, since the testing program 36*b* including the test sequence and testing patterns is stored in the nonvolatile memory 36 of the display device 30, the testing device 30 does not need such an intricate circuitry as the signal source device 80 (FIG. 10) including a conventional MPU.

The interface section 34 is realized as n-bits (where n is 8, 9, 16, and the like) CPU bus interface, typified by 80-type CPU. The interface section 34 is connected to the RGB terminal 37. In normal displays, the interface section 34 receives a command and a parameter via the RGB terminal 37. Meanwhile, in the display test, the interface section 34 receives a test control signal from the testing device 40. Note that, the CPU bus interface may be described as command interface in the specification.

Further, the interface section 34 is connected via a RAM data input port 12*b* to RAM (random-access memory) 12*c* of the source driver 12'. This allows the interface section 34 to write image data into the RAM 12*c* in accordance with input signals from the RGB terminal 37 and data read from the nonvolatile memory 36, thus controlling the column electrode drive section 12*e* and the gate driver 13.

When the interface section 34 detects a test control signal supplied from the RGB terminal 37, it identifies a test command contained in the test control signal in accordance with the test command list 36*a* and reads and executes the corresponding execution code. That is, the interface section 34 reads the testing program 36*b* for necessary testing items one by one in steps. For example, when the test command is "test mode ON", the display mode is changed from normal mode to test mode. This allows the display device 30 to change the display mode between the normal mode for normal displays and the test mode for testing pattern displays.

Further, in the display test, when the interface section 34 receives the test command "Proceed with a test sequence" from the testing device 40, it proceeds with the test sequence and displays the testing pattern on the display panel 11.

Note that, the display device 30 may additionally include other display modes, e.g. a display mode in which the number of colors is reduced to lower power consumption, as well as the normal mode corresponding to a model specification.

Moreover, the display device 30 has an arrangement in which the interface section 34 as CPU bus interface is provided instead of the control section 12*a* provided with the test terminal 18 of the display device 10. This eliminates the need for the test terminal 18 (FIG. 1). Therefore, the display device 30 is a preferable device in the case where a test control pin cannot be provided because of limitation on its outer shape and the number of terminals, and other restrictions.

The nonvolatile memory 36 can be realized by EEPROM (electrically erasable and programmable ROM). The nonvolatile memory 36 stores, as the testing program 36*b*, the test sequence representing the procedures for a display test for the display device 30 and the testing patterns each representing image information to be displayed for the display test. The nonvolatile memory 36 stores the test command list 36*a* in which test commands supplied from the testing device 40 are registered with execution codes corresponding to the test commands so that the execution of the testing program 36*b* can be controlled from the testing device 40. Note that, in addition to the test command list 36*a* and the testing program 36*b*, the nonvolatile memory 36 can store, as other data 36*c*, data for driving the display panel 11, e.g. a setting value in the normal mode. Note that, the content and amount of other data 36*c* vary depending on the model of the display device 30.

FIG. 8 shows an example of the test command list 36*a*. In FIG. 8, "TEST IN (F0)", "TEST OUT (F1)", "TEST INC (F2)", and "TEST DEC (F3)" are the testing program 36*b*, and the others are user commands. Note that, in FIG. 8, the execution code corresponding to each of the test commands is omitted. The user command will be described later.

When the interface section 34 detects the test control signal supplied through the RGB terminal 37, the interface section 34 identifies a test command contained in the test control signal out of the test commands (F0 to F3) in accordance with the test command list 36*a* and performs the operation corresponding to the content of the test command.

FIG. 2 shows an example of the testing program 36*b*. As shown in FIG. 2, the testing program 36*b* consists of eight steps. The testing program 36*b* is executed by incrementing addresses 1 through 8 in accordance with a test command supplied through the RGB terminal 37. Note that, the structure of the command is as described in the First Embodiment.

Next, operations in the display test will be described.

The display test for the display device 30 starts when the interface section 34 receives the test command "TEST IN (F0)" supplied via the RGB terminal 37 from the testing device 40. In this operation, the testing program 36*b* is read from the nonvolatile memory 36 into the interface section 34. On the other hand, when the interface section 34 receives the test command "TEST OUT (F1)", the test sequence is stopped.

Then, every time the interface section 34 receives the test command "TEST INC (F2)", the interface section 34 increments the address of the testing program 36*b* and changes a signal to be supplied to the source driver 12'. That is, in accordance with the test command "TEST INC (F2)", an address for reading the testing program 36*b* stored in the nonvolatile memory 36 is incremented so that the test sequence goes forward to the subsequent step. Similarly, every time the interface section 34 receives the test command "TEST DEC (F3)", the interface section 34 decrements the address of the testing program 36*b* so that the test sequence goes back to the previous step.

Thus, since the display device 30 can process the test commands "TEST INC (F2)" and "TEST DEC (F3)", facilities for redoing the test sequence, such as "move to the next screen" and "go back to the previous screen", can be realized.

FIG. 3 is a flowchart showing the operations by the testing program 36*b* shown in FIG. 2. The interface section 34 issues a command for each step and controls the source driver 12' and the gate driver 13 to carry out the processing of display test. Note that, the operation for each step is as described in the First Embodiment.

Here, the type of the test mode for the display device 30 includes "full display mode" and "partial display mode". Note that, the "full display mode" and the "partial display mode", and the structure of the testing patterns are as described in the First Embodiment with reference to FIGS. 4 through 6.

Thus, the display device 30 incorporates the testing program 36*b* including the test sequence and the image information for the testing patterns in the nonvolatile memory 36. This eliminates the need for the excessive preparation of a large number of testing devices 40 and many intricate testing programs, which were required for a module with a large number of models.

Further, in the display device 30, image information with minimum unit (1×1 pixel, 2×2 pixels, or other unit) that has been stored as image information for the testing pattern is displayed longitudinally and laterally in repeating fashion, thus realizing a small data capacity of the nonvolatile memory 36.

Note that, although the above description was based on the case of storing one testing program 36*b* in the nonvolatile memory 36, it is also possible to store a plurality of testing programs and to externally designate a testing program to be executed out of the testing programs. Specifically, since the interface section 34 which is a CPU bus interface has a command system, additional commands may be provided. Even in the manufacturing process that requires various display tests, this makes it possible to change a plurality of testing programs to distinguish among the uses of multiple test sequences.

Further, in the display device 30, the test commands for use in a display test can be provided separately from the user commands used by users (companies A, B, and C) (FIG. 8). In this case, the interface section 34 can distinguish between the user command and the test command and change the control of the source driver 12 and the gate driver 13. Note that, the user command region is included in other data 36*c*. In addition, the locations where the test commands are stored (F0 through F3) are shared among models of the display device so that the testing device 40 can be shared among the models of the display device.

As described above, in the display devices 10 and 30, the nonvolatile memories 16 and 36 store the respective testing programs 16*a* and 36*b* each including the test sequence for a display test and the testing patterns. Therefore, since the testing devices 20 and 40 need not supply a display signal for a display test to the display devices 10 and 30, the testing devices 20 and 40 do not require such an intricate circuitry as the signal source device 80 (FIG. 10) including a conventional MPU. Moreover, unlike the signal source device 80, since rewriting of a storage device does not occur with model change of the display devices 10 and 30, the testing devices 20 and 40 can be shared.

Note that, applicable to the display panel 11 are not only various liquid crystal display panels including reflective, transmissive, semi-transmissive, and STN (super twisted nematic) liquid crystal display panels but also display devices using organic electroluminescence, TFD (thin film diode), LPS (low temperature poly silicon), and other material.

The nonvolatile memories 16 and 36, which are mounted respectively in the display devices 10 and 30, are recording media storing the test sequence and the testing patterns that can be supplied to the control section 12*a* and the interface section 34, respectively. Although EEPROM is preferable for the nonvolatile memories 16 and 36, other recording media can be used for the nonvolatile memories 16 and 36 provided that they are nonvolatile. For example, a nonvolatile memory with a shorter writing time than EEPROM and with no limit on the number of times for writing may be adopted. RAM with energy source to maintain data in the absence of power may be also adopted. Further, like SRAM (static RAM) including EEPROM mounted thereon, an integrated combination of RAM and EEPROM may be adopted. In this case, the RAM 12*c* and the nonvolatile memory 16 can be integrated.

Further, the above description assumed that in the display devices 10 and 30, a video signal supplied in the normal mode was RGB signal. However, a signal in other system may be adopted. In this case, instead of the RGB terminal 37, it is safe to provide a terminal in accordance with the type of the video signal.

Still further, the above description assumed that in the display device 30, the source driver 12' and the interface section 34 are separate blocks. However, they can be realized as single-membered circuit.

The above embodiments are not intended to limit the scope of the present invention, and still other variations are possible within the scope of the present invention. For example, the present invention can be arranged as follows.

A display device of the present invention, which is a display device of command interface module, may be arranged so as to include a test-use input control terminal which is different from a terminal for command interface-use input signal and a nonvolatile memory for storing test-use input patterns and a test sequence. This makes it possible to automatically change a testing pattern and a display mode for the display device only via the test-use input control terminal.

A display device of the present invention, which is a display device of command interface module, may be arranged such that commands for a test are separately prepared, and a nonvolatile memory for storing test-use input patterns and a test sequence. This makes it possible to automatically change a testing pattern and a display mode for the display device using a simple test command.

A display device drive circuit of the present invention may include a test facility of reading test patterns and a test sequence for a display device which are written in the nonvolatile memory in accordance with an external input signal.

A display device drive circuit of the present invention may include test facility of reading test patterns and a test sequence for a display device which are written in the nonvolatile memory in accordance with an external test command.

A display device drive circuit of the present invention may be arranged so that image information with minimum unit of a testing pattern is stored in the nonvolatile memory, and the testing pattern is generated by displaying data of the image information longitudinally and laterally in repeating fashion, so as to carry out a display test.

A display device drive circuit of the present invention may be arranged so that image information with minimum unit of a testing pattern is stored in the nonvolatile memory, and the processing of displaying data of the image information longitudinally and laterally in repeating fashion is carried out.

As described above, a display device of the present invention which is provided with display means and drive means for driving the display means, includes:

nonvolatile storage means for storing a test sequence representing procedures for a display test and testing patterns to be displayed in a display test; and interface means for reading out a test sequence and testing patterns from the nonvolatile storage means in accordance with a test control signal supplied externally and controlling the drive means so as to display the testing patterns on the display means in accordance with the test sequence.

According to the above arrangement, on the display device, which is a testing target, mounted is nonvolatile storage means (for example, EEPROM) which store a test sequence representing the procedures for a display test such as change of a display mode and testing display patterns. Then, the interface means read out the test sequence and the testing patterns from the nonvolatile storage means in accordance with a test control signal supplied from an external testing device and controls the drive means so as to display the testing patterns on the display means in accordance with the test sequence.

This makes it possible to carry out a display test using the test sequence and the testing patterns incorporated in the display device. Therefore, unlike the conventional testing device, there is no need to incorporate the test sequence and the testing patterns in the testing device.

Consequently, the display test for a display device with a large number of models requires no cumbersome and extensive tasks of preparing testing devices respectively corresponding to the models of the display device and a great number of complex data of the test sequence and testing pattern which are respectively suitable for the models of the display device and storing them in the testing devices, respectively. That is, it is possible to drastically reduce preparations for a display test.

Note that, the test sequence and the testing patterns, grouped together in one testing program, can be stored in the nonvolatile storage means. As to the testing pattern, image information with minimum unit (for example, 2×2 pixels) that has been stored in the nonvolatile storage means is displayed longitudinally and laterally in repeating fashion, thus realizing a small capacity of the nonvolatile storage means.

Further, a display device of the present invention can be arranged in which in addition to the normal input signal terminal, a test terminal for receiving a test-use signal (for example, pulse signal) as the test control signal is provided, and the interface means proceed with the test sequence in accordance with the pulse signal.

According to the above arrangement, provision of the test terminal to the display device and input of the pulse signal from the testing device via the test terminal further make it possible to control the test sequence for the display test.

Therefore, the testing device does not require a storage device for storing a test sequence and testing patterns. It is safe for the testing device to include only a terminal for outputting the pulse signal. This can realize the testing device with a simple structure. That is, a testing device complex in structure is not necessary for a display test.

Further, in a display device of the present invention, the nonvolatile storage means further store a test command list including execution codes respectively corresponding to the test commands, and the interface means identify an execution code corresponding to a test command contained in the test control signal in accordance with the test command list so as to proceed with the test sequence in accordance with the execution code.

A testing device of the present invention supplies the test control signal containing the test command to the above display device.

According to the above arrangement, internal storage of the test command list in the display device and input of the test control signal including the test command from the testing device further make it possible to control the test sequence for the display test.

Therefore, the testing device does not require a storage device for storing a test sequence and testing patterns. It is safe for the testing device to include a facility for outputting the test control signal including the test command. This can realize the testing device with a simple structure. That is, a testing device complex in structure is not necessary for a display test.

A recording medium of the present invention is nonvolatile storage means mounted on the display device.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A display device, comprising:

nonvolatile storage means for storing a test sequence representing procedures for a display test and testing patterns to be displayed in a display test;

interface means for reading out the test sequence and the testing patterns from the nonvolatile storage means in accordance with a test control signal supplied externally and controlling display of the testing patterns in accordance with the test sequence; and means for changing between a full display mode and a partial display mode during the test sequence.

2. The display device according to claim 1, further comprising:

a test terminal for receiving a pulse signal as the test control signal, wherein the interface means proceed with the test sequence in accordance with the pulse signal.

3. The display device according to claim 2, wherein:

the testing pattern includes image information with minimum unit, and by the test sequence, the image information with minimum unit is displayed at least one of longitudinally and laterally in repeating fashion.

4. The display device according to claim 1, wherein:

the nonvolatile storage means also stores a test command list including execution codes respectively corresponding to test commands, and the interface means identify an execution code corresponding to a test command contained in the test control signal in accordance with the test command list so as to proceed with the test sequence in accordance with the execution code.

5. The display device according to claim 4, wherein:

the testing pattern includes image information with a minimum unit that is one of 1×1 pixel and 2×2 pixels, and by the test sequence, the image information with the minimum unit is displayed at least one of longitudinally and laterally in repeating fashion.

6. The display device according to claim 1, wherein:

the testing pattern includes image information with a minimum unit that is one of 1×1 pixel and 2×2 pixels, and by the test sequence, the image information with the minimum unit is displayed at least one of longitudinally and laterally in repeating fashion.

7. A drive circuit included in display device, the drive circuit comprising:

nonvolatile storage means for storing a test sequence representing procedures for a display test and testing patterns to be displayed in a display test;

interface means for reading out a test sequence and testing patterns from the nonvolatile storage means in accordance with a test control signal supplied externally and controlling the display of the testing patterns in accordance with the test sequence; and means for changing the display device from a full display mode to a partial display mode during the test sequence.

8. The drive circuit according to claim 7, further comprising:

a test terminal for receiving a pulse signal as the test control signal, wherein the interface means proceed with the test sequence in accordance with the pulse signal.

9. The drive circuit according to claim 8, wherein:

the testing pattern includes image information with minimum unit, and by the test sequence, the image information with minimum unit is displayed at least one of longitudinally and laterally in repeating fashion.

10. The drive circuit according to claim 7, wherein:

the nonvolatile storage means also stores a test command list including execution codes respectively corresponding to test commands, and the interface means identifies an execution code corresponding to a test command contained in the test control signal in accordance with the test command list so as to proceed with the test sequence in accordance with the execution code.

11. The drive circuit according to claim 10, wherein:

the testing pattern includes image information with a minimum unit that is one of 1×1 pixel and 2×2 pixels, and by the test sequence, the image information with the minimum unit is displayed at least one of longitudinally and laterally in repeating fashion.

12. The drive circuit according to claim 7, wherein:

the testing pattern includes image information with a minimum unit that is one of 1×1 pixel and 2×2 pixels, and by the test sequence, the image information with the minimum unit is displayed at least one of longitudinally and laterally in repeating fashion.

13. A display device comprising:

nonvolatile storage means for storing a test sequence representing procedures for a display test, testing patterns to be displayed in a display test, and a test command list including execution codes respectively corresponding to test commands; and interface means for identifying, in accordance with the test command list, an execution code corresponding to a test command which is contained in a test control signal supplied externally, reading out a test sequence and testing patterns from the nonvolatile storage means in accordance with the execution code, controlling the display of the testing patterns in accordance with the test sequence, and changing between a full display mode and a partial display, wherein the test control signal including the test command being supplied to the display device.

14. A recording medium including executable instructions, which when executed by a display device, cause the display device to perform a method comprising:

storing a test sequence representing procedures for a display test and testing patterns to be displayed in a display test; and reading out a test sequence and testing patterns from the nonvolatile storage means in accordance with a test control signal supplied externally, controlling the display of the testing patterns in accordance with the test sequence, and changing between a full display mode and a partial display mode.

15. A recording medium including executable instructions, which when executed by a display device, cause the display device to perform a method comprising:

reading out a test sequence and testing patterns from the recording medium in accordance with a test control signal supplied externally, controlling the display of the testing patterns in accordance with the test sequence, and changing between a full display mode and a partial display mode during the test sequence.

* * * * *